United States Patent [19]

De Nora et al.

[11] 4,073,715

[45] Feb. 14, 1978

[54] ELECTROLYSIS CELL WITH VERTICAL ANODES AND CATHODES AND METHOD OF OPERATION

[75] Inventors: Oronzio De Nora, Milan, Italy; Vittorio De Nora, Nassau, Bahamas

[73] Assignee: Oronzio de Nora Impianti Elettrochimici, S.p.A., Milan, Italy

[21] Appl. No.: 655,493

[22] Filed: Feb. 5, 1976

[30] Foreign Application Priority Data

Nov. 28, 1975 Italy ..... 29782/75

[51] Int. Cl.[2] ..... C25B 1/34; C25B 9/00; C25B 11/03

[52] U.S. Cl. ..... 204/256; 204/255; 204/268; 204/269; 204/275; 204/278; 204/283

[58] Field of Search ..... 204/256, 278, 254, 255, 204/268, 269, 275

[56] References Cited

U.S. PATENT DOCUMENTS

| | | | |
|---|---|---|---|
| 3,755,108 | 8/1973 | Roetzsch et al. | 204/98 |
| 3,809,630 | 5/1974 | De Nora et al. | 204/98 |
| 3,875,040 | 4/1975 | Weltin et al. | 204/267 |
| 3,930,980 | 1/1976 | De Nora et al. | 204/256 |

*Primary Examiner*—F.C. Edmundson
*Attorney, Agent, or Firm*—Hammond & Littell

[57] ABSTRACT

Describes an electrolysis cell and method of operation in which metal anodes (preferably titanium) provided with an electrically conducting electrocatalytic coating, in an anode compartment, face metal cathodes (preferably diaphragm covered) in a cathode compartment, in which the anodes are spaced from an imperforate valve metal separating partition by a separating wall behind which the anolyte can recirculate downward. The anodic gases rising in the anode compartment discharge into a brine box above the anode compartment near the center thereof and the anolyte recirculates downward near at least one end of the anode compartment, and a method of operation which provides circulation from front to back of the anode compartment and from center to the sides of the anode compartment.

30 Claims, 21 Drawing Figures

FIG. 18
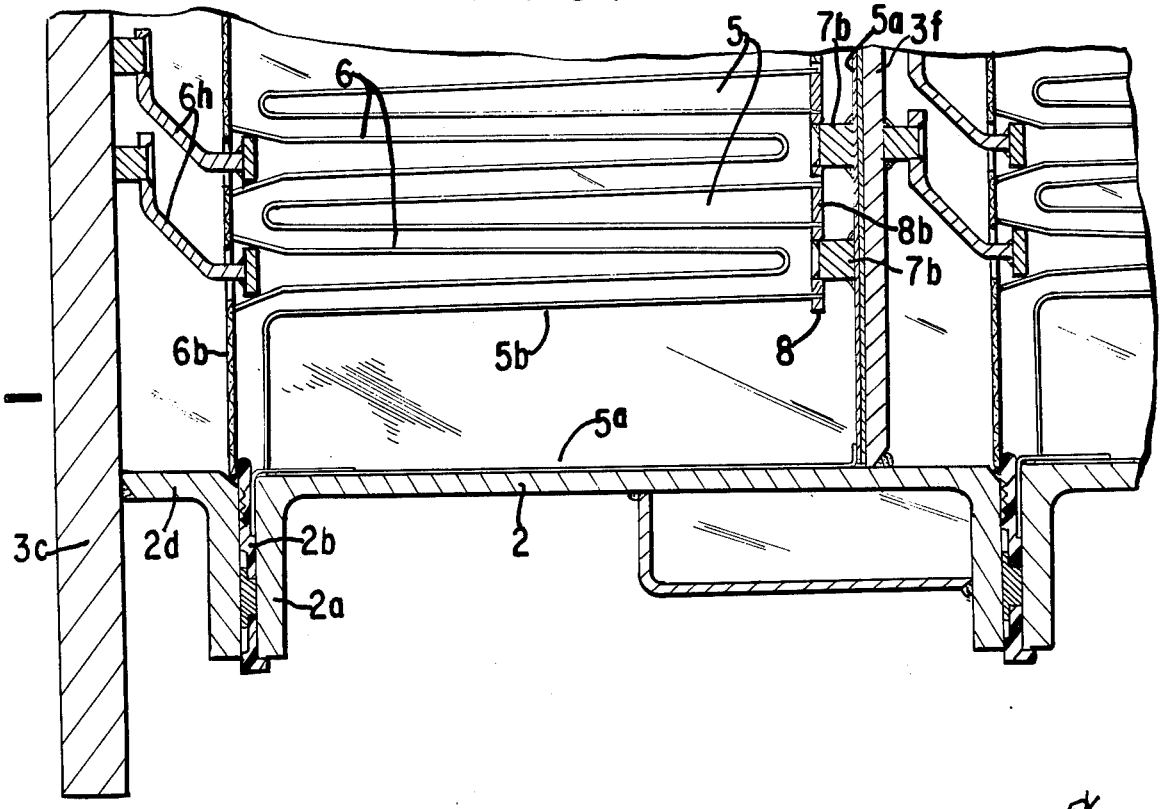
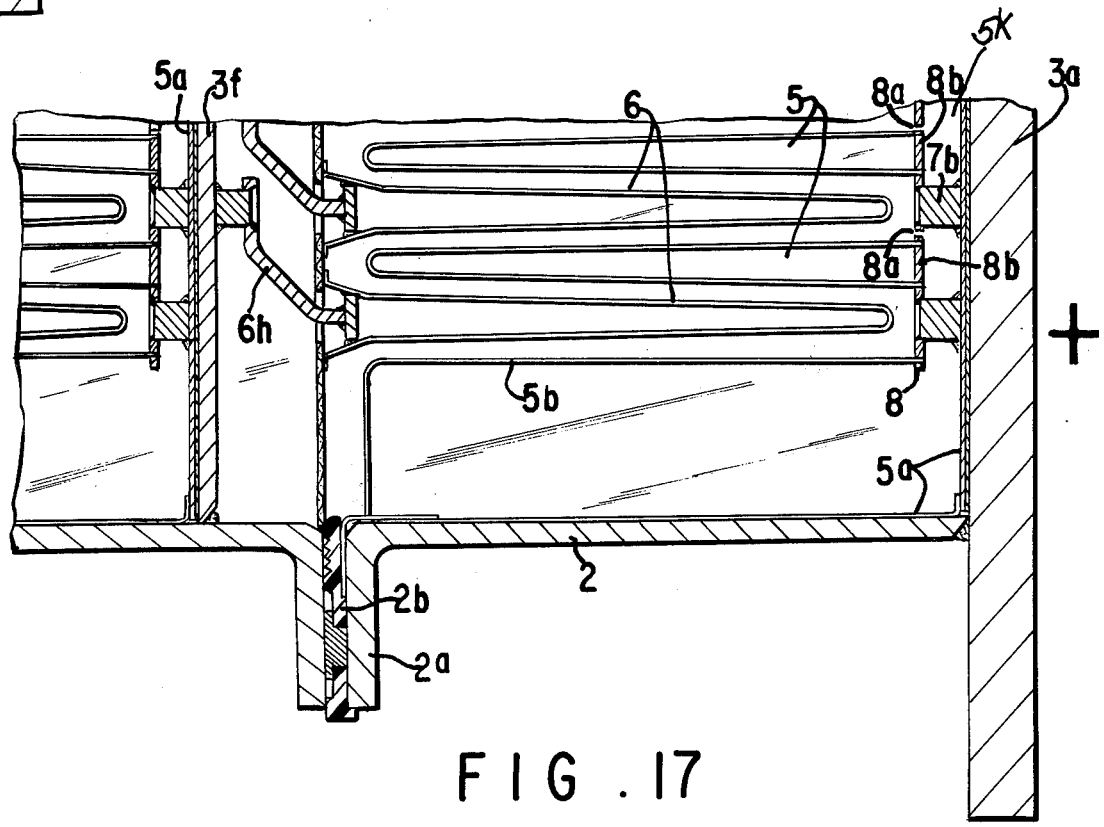
FIG. 17

ELECTROLYSIS CELL WITH VERTICAL ANODES AND CATHODES AND METHOD OF OPERATION

This invention relates to electrolysis cells and methods of electrolysis as used, for example, for the electrolysis of alkali metal halides such as lithium, sodium and potassium chlorides, bromides and iodides and, more generally, for the electrolysis of halogenides and for the electrolysis of other salts which undergo electrolytic decomposition under electrolysis conditions, for the production of chlorates or perchlorates, for the electrolysis of hydrochloric acid to produce hydrogen and chlorine, for the electrolysis of water to produce hydrogen and oxygen, for the electrolysis of sodium and potassium sulfate to produce caustic soda or caustic potash and sulfuric acid, for the electro-osmosis and electrodialysis, for organic oxidation and reduction reactions, and for other processes which may be carried out by electrolysis reactions.

The cell and method will be described for the electrolysis of sodium chloride to produce chlorine and caustic soda, but this is only for the purpose of illustrating the invention. It will also be described as a multiple unit bipolar cell, but it will be understood that it may be operated as individual units, either separately or connected together by intermediate connections.

One of the objects of this invention is to provide new types of electrodes and electrolysis cells in which anodic and cathodic reactions may be carried out more efficiently than in prior electrolysis cells, which are easier and cheaper to construct and maintain in service and which have a longer life between dismantling for diaphragm replacement and other repairs than prior electrolysis cells.

Another object is to provide electrolysis cells which have a greater recirculation of the electrolyte within the anolyte compartment than prior electrolysis cells.

Another object is to provide an electrolysis cell and process in which the electrolyte circulation through the cell provides more uniform electrolyte composition throughout the cells than prior electrolysis cells and prolongs the normal life of the diaphragms.

Another object is to provide an electrolysis cell in which diaphragm material may be added to the electrolyte and circulated through the electrolysis cell to deposit additional diaphragm material on the diaphragm as needed and to provide means to make such additions.

Another object is to provide an electrolysis cell and process in which the electrolyte is circulated upwardly by the anodic gases in the interelectrodic gap between the anodes and cathodes and within the hollow fingers or waves of the anodes and downwardly behind the anodes, and is also recirculated upwardly toward the center and downwardly toward at least one side of the cell, to thereby provide circulation of the electrolyte from front to back and from the center to the sides of each cell unit.

Another object is to provide an electrolysis cell and process in which the anodic gases have a larger space in which to escape from the electrolysis gap and from the cell with a minimum of obstruction against their escapes, to thereby provide greater circulation of the electrolyte within the cell.

Another object is to provide imperforate metal separating partitions between the cell units of a bipolar cell in which the separating partitions on the anodic side are non-corrosive to anodic conditions and on the cathodic side are non-corrosive to cathodic conditions.

Another object is to provide an electrolysis cell and method in which the anodes and cathodes may be individually assembled on the anode and cathode supports.

Various other objects and advantages of this invention will appear as this description proceeds.

Referring now to the drawings, which show one embodiment of the invention for the purpose of illustration:

Figure 8:
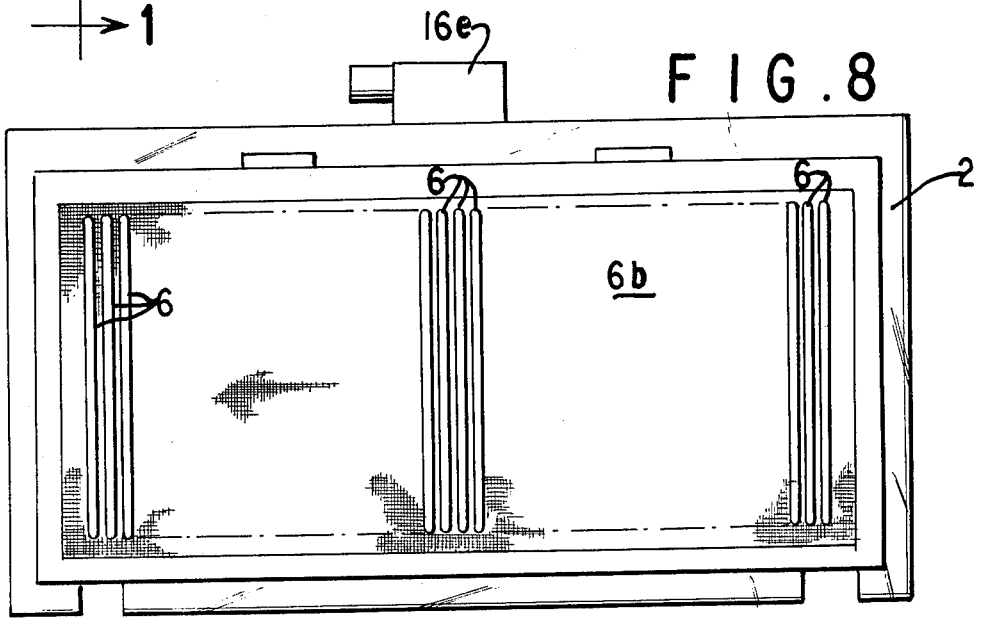
Figure 5:
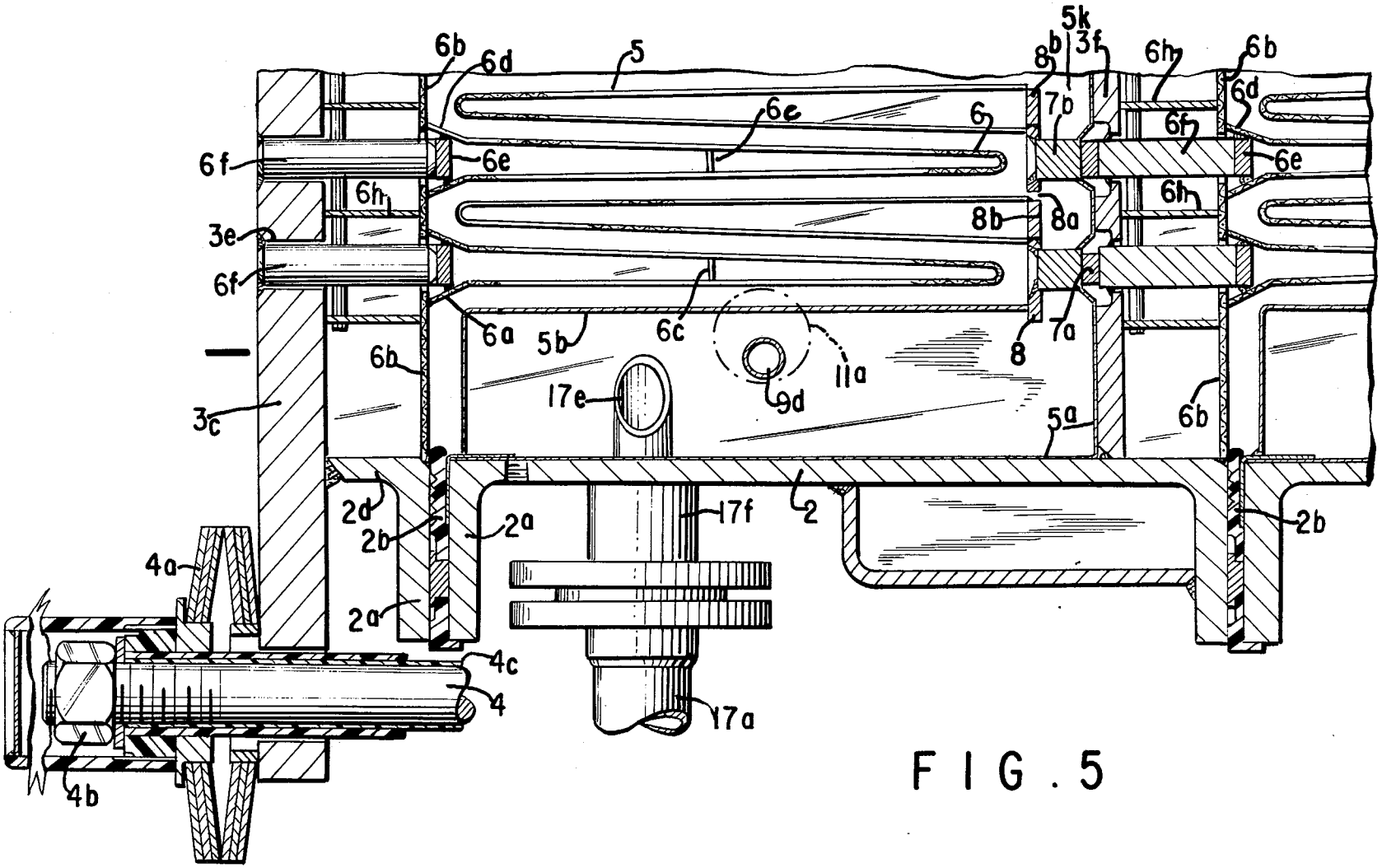
FIG. 5 is a cross-sectional plan view of a portion of a bipolar cell unit at the cathode end of the cell, showing one intermediate separating partition.
Figure 5A:
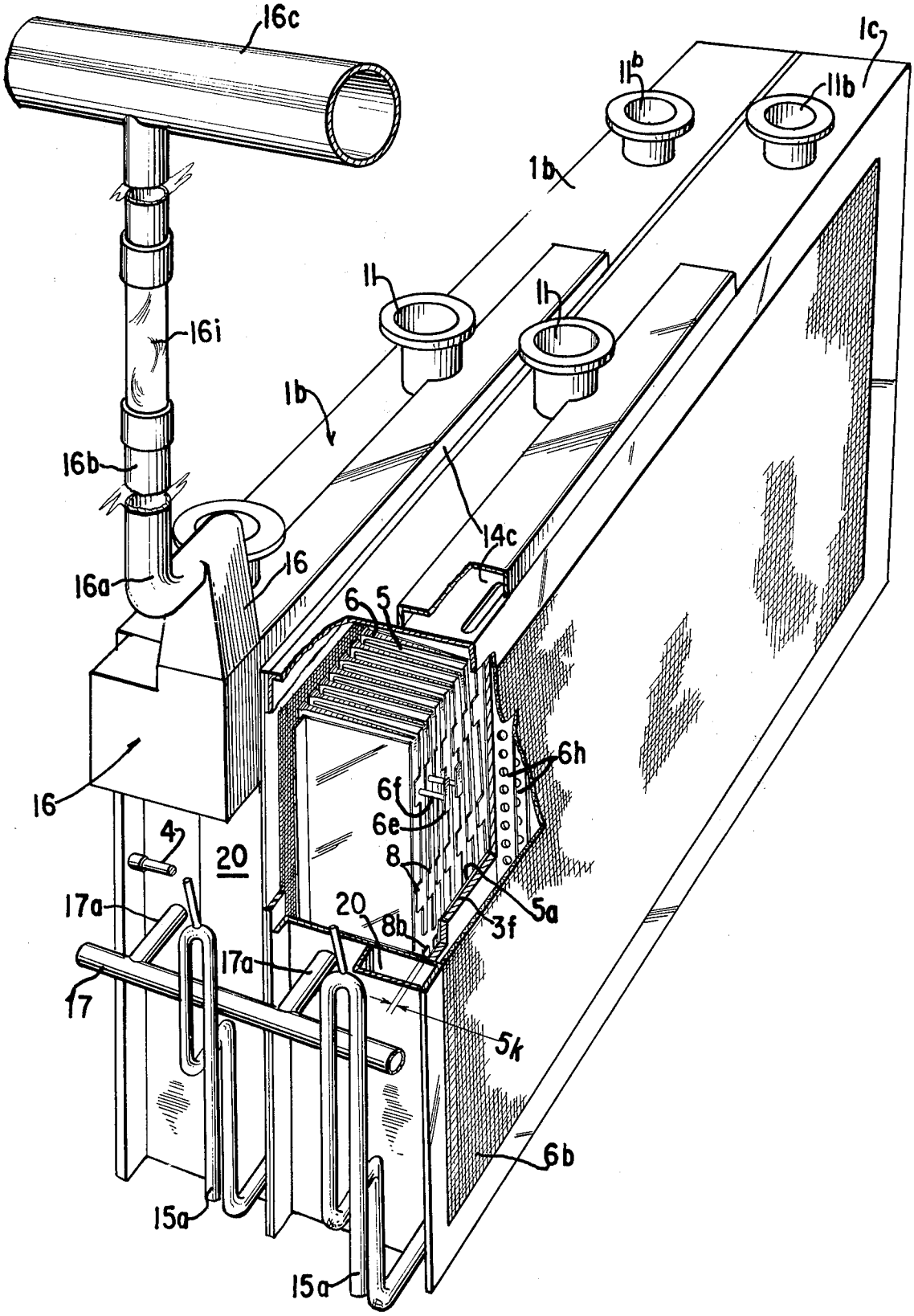
Figure 6:
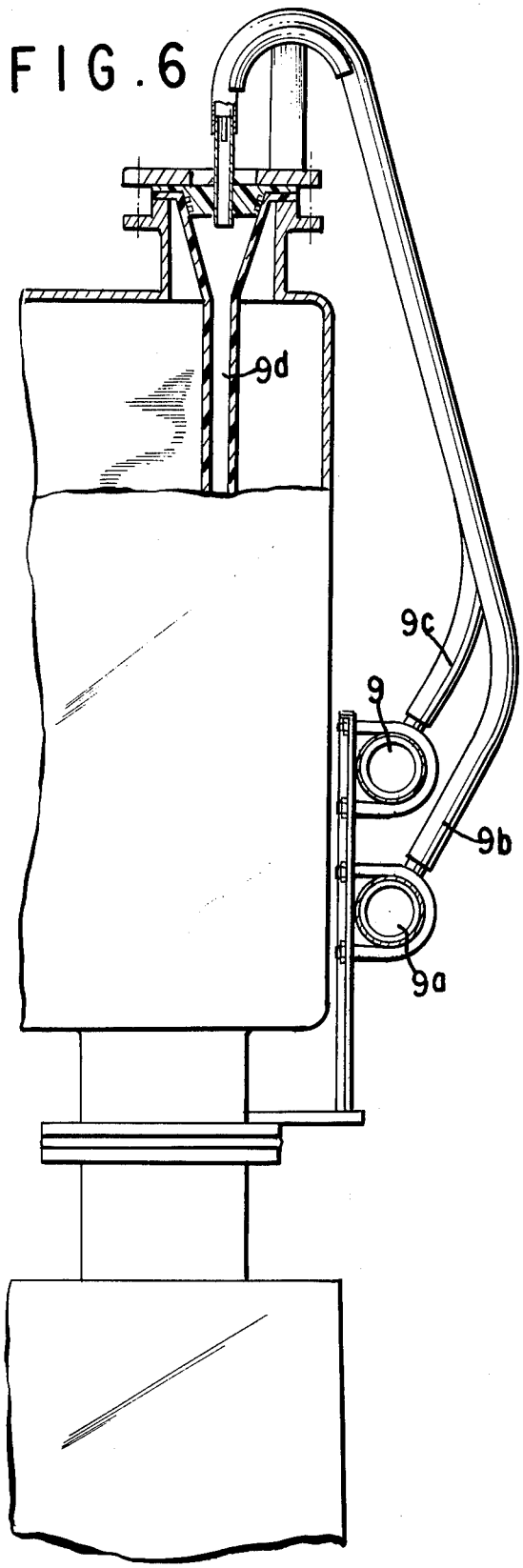
Figure 7:
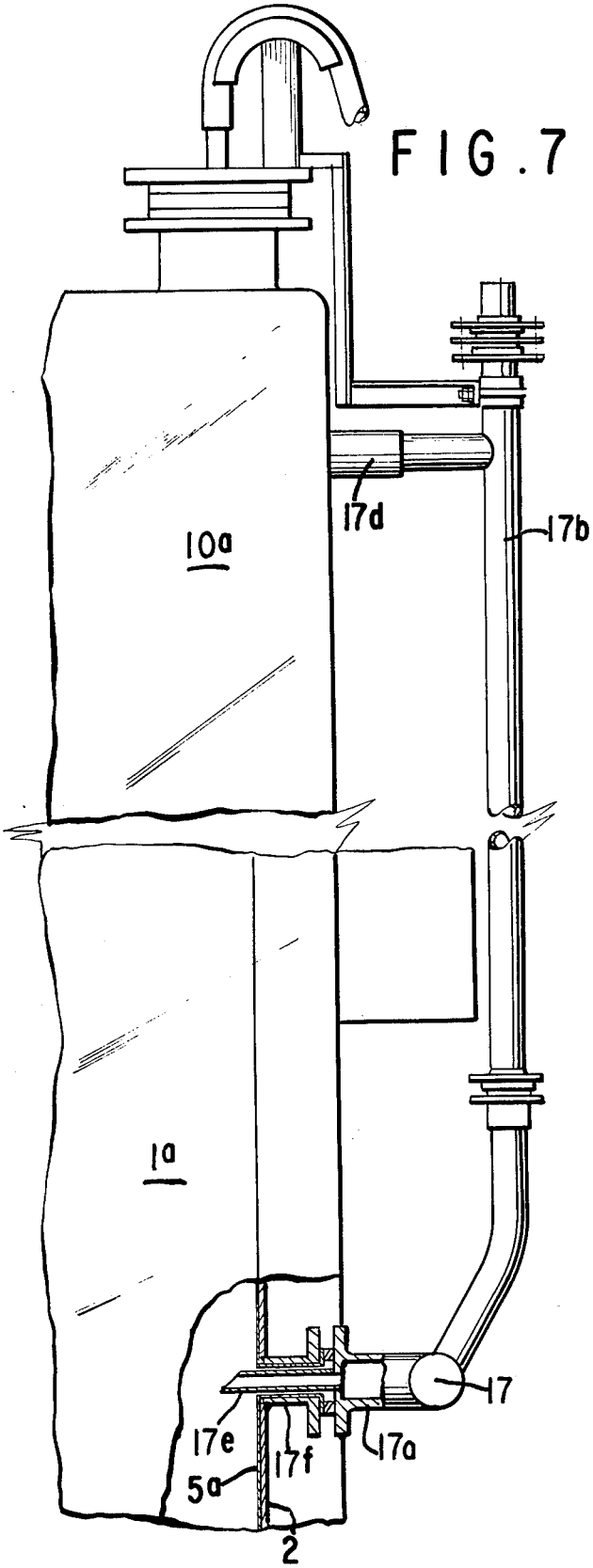
Figure 9:
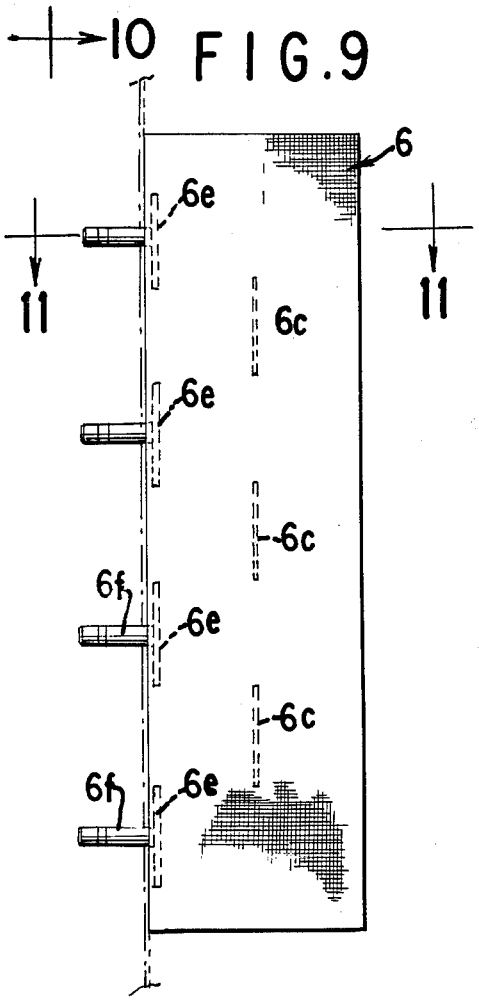
Figure 10:
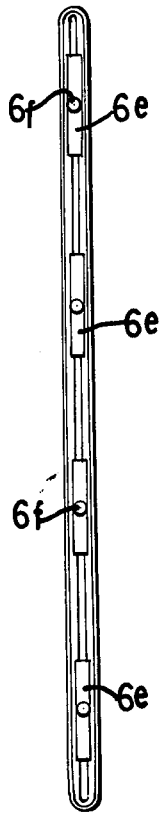
Figure 12:
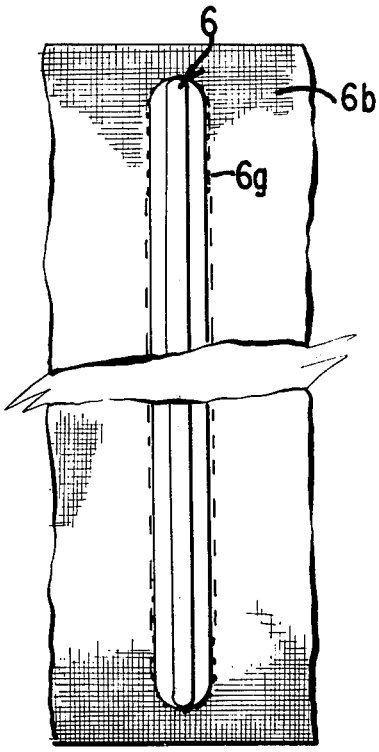
Figure 11:
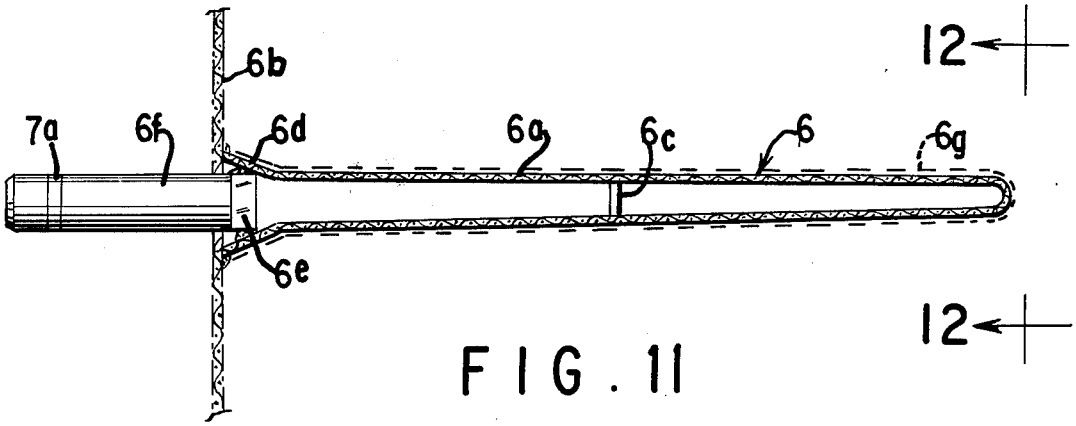
Figure 13A:
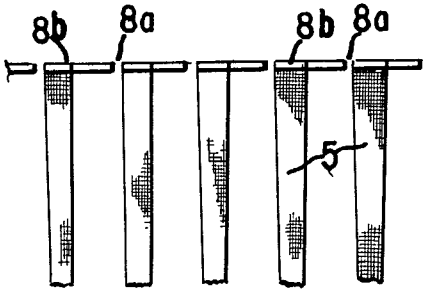
Figure 13:
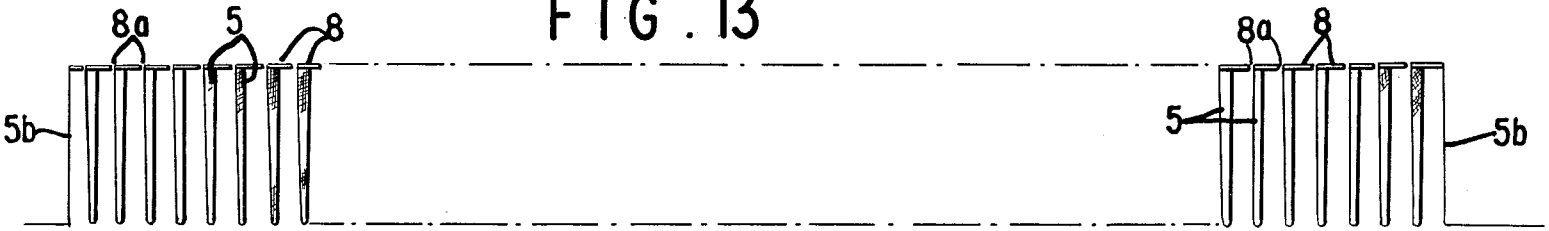

FIG. 5*a* is a partial perspective view of two cell units with parts broken away;

FIG. 6 is a part-sectional view of the feed line assembly used in each cell unit;

FIG. 7 is a side view, partially in section, of the brine level equalizer and brine level indicator;

FIG. 8 (Sheet 3) is a side view, partially in section, of a cathode end frame;

FIG. 9 is a side view of one of the cathode fingers;

FIG. 10 is a part-sectional end view of a cathode finger, substantially along the line 10 — 10 of FIG. 9;

FIG. 11 is a sectional plan view of a cathode finger, substantially along the line 11 — 11 of FIG. 9;

FIG. 12 is a face view of a cathode finger;

FIG. 13 is a plan view of an anode assembly and

Figure 16:
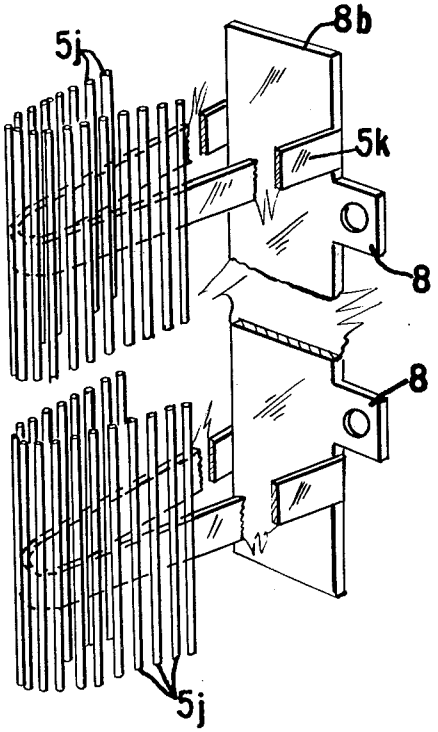
Figure 15:
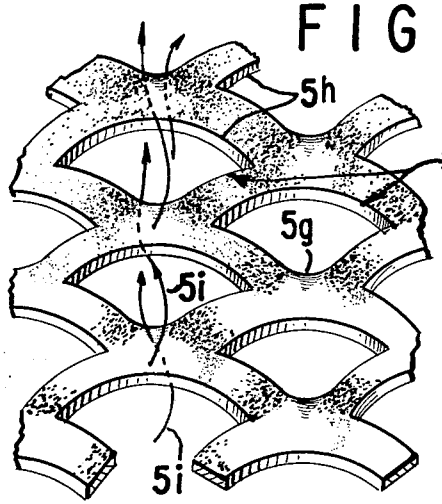
Figure 14A:
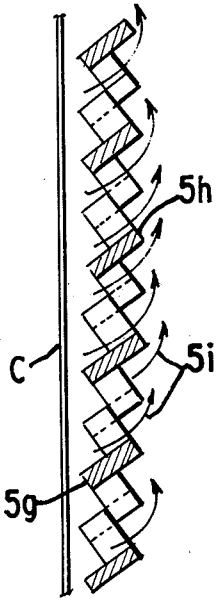
Figure 14:
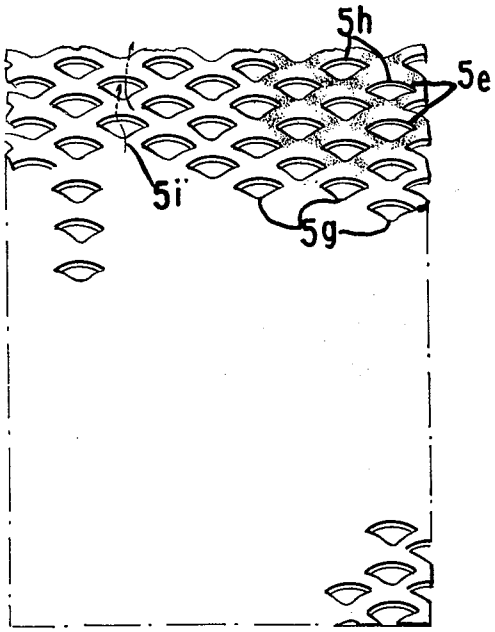

FIG. 13a is an enlarged area of FIG. 13;

FIGS. 14, 14a and 15 are details of the anode wall construction;

FIG. 16 shows vertically mounted rod anodes;

FIG. 17 is a sectional plan view of the anode end of a modified cell construction; and FIG. 18 is a sectional plan view of the cathode end of the modified cell of FIG. 17.

Figure 2:
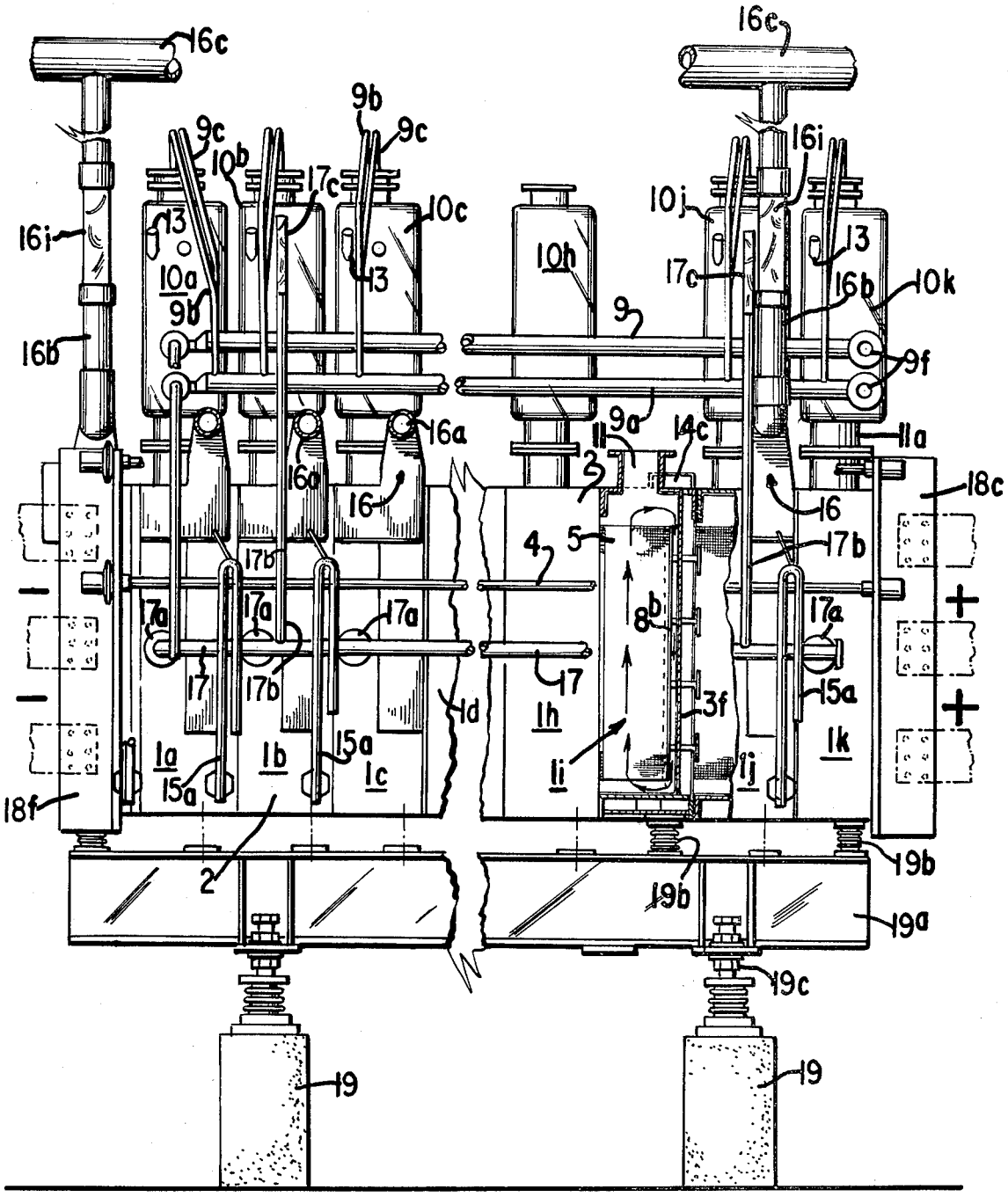
FIG. 2 is a part-sectional side view, with parts broken away and portions omitted, of the cell illustrated in FIG. 1.

The bipolar cell of this invention comprises a plurality of rectangular cell units, 1*a* - 1*b* - 1*c* - 1*h* - 1*i* - 1*j* - 1*k*, etc. (FIG. 2). The number of cell units may vary according to the capacity desired. The embodiment illustrated comprises ten bipolar cell units, an anode end element and a cathode end element, making eleven individual cell units in bipolar connection. The number of such units may be larger or smaller than illustrated. Each cell unit has a brine box, 10*a*, 10*b*, 10*c*, 10*d*, 10*e*, 10*i*, 10*j*, 10*k*, preferably mounted on the top thereof (FIG. 3) although the brine boxes may be suspended above the cell units and connected thereto. Any cell unit may be used as a single bipolar cell and current connection between one or more separate bipolar cell units may be provided. Each cell unit is mounted in a rectangular metal frame 2, with end flanges 2*a* (FIGS. 4, 5 and 5*a*), which abut against similar end flanges of the adjacent cell frames 2. Suitable insulating gaskets 2*b* are provided between the flanges of each intermediate frame unit which, together with the long bolts 4, maintain the assembled cell units in fluid-tight connection. The frame 2 of the anode end element 1*k* is welded or otherwise secured to the anode end plate 3*a*, as illustrated at 2*c* in FIG. 4. The flanges 2*a* of the rectangular frame 2, adjacent the cathode end element 1*a* abuts against a flanged cathode end frame 2*d*, with an insulating gasket 2*b* between each set of flanges 2*a*, as shown in FIG. 5. The flanged cathode end frame 2*d* is welded or otherwise secured to the cathode end plate 3*c*.

The assembly of cell units is held together by a plurality of long bolts 4 covered with plastic sleeves 4*c* and suitably insulated from the end plates 3*a* and 3*c*. The cathode end of each log bolt 4 is provided with spring washers 4*a* and detachable nuts 4*b*, as illustrated in FIGS. 4 and 5. The long bolts are spaced from the rectangular frames 2 and flanges 2*a*.

The intermediate units of the bipolar cell illustrated are all substantially the same. The anode end element and the cathode end element of each cell assembly differ from the intermediate units in the construction necessary to secure the positive electrical connections to the anode end and the negative connections for the cathode end of the cell assembly, and in other details necessary at the end units more particularly as illustrated in FIGS. 4 and 5.

Each rectangular frame 2 houses a series of anodes 5 and cathodes 6 within the frame 2. The anodes 5 and cathodes 6 are preferably in nested, hollow finger or wave form, as illustrated in FIGS. 4 and 5 (also FIGS. 13, 17 and 18), but may be flat plates or have other forms. The hollow wave form provides greater anode and cathode surface within the frames 2 than any other form. The anodes 5 are formed of a metal resistant to anodic conditions, such as titanium, tantalum zirconium, niobium or other valve or film forming metal or alloys of these metals. The walls of each anode compartment, where exposed to the anolyte and anodic conditions, are lined with a corrosion-resistant lining, such as titanium or tantalum or alloys thereof 5*a*, or a suitable polyester or other resin plastic. The titanium, tantalum or other valve metal of the anodes 5 may be solid, reticulated, rod, screen or other open form. The anodes are coated on either the inside or outside, or both sides of the hollow fingers 5, with an electrically conducting electrocatalytic coating, such as one containing a platinum group metal or a platinum group metal oxide together with titanium and/or other metals or oxides as desired, such as described, for example, in U.S. Pat. Nos. 3,632,498 and 3,711,385.

The cathode fingers 6 are preferably formed of metal screen 6*a* (FIGS. 5 and 11) and project from a metal screen backing 6*b*. The cathode waves or fingers are closed at the top and bottom with metal screen material. A suitable diaphragm of asbestos or an ion-permeable diaphragm material may be applied to the screens 6*a* and 6*b* to separate the anode compartment of each cell unit from the cathode compartment. Suitable reinforcements 6*c* may be provided in the interior of the screen cathode fingers to prevent them from collapsing if the diaphragm material is deposited by vacuum on the screen fingers. The diaphragm material covers the side walls as well as the top and bottom of the cathode fingers 6 and the screen backing 6*b*. The diaphragms 6*g* are only partially and diagrammatically shown by the dash lines in FIGS. 11 and 12, but it will be understood that the fingers 6 and backing screens 6*b* are completely covered with diaphragms. The backing screens 6*b* are spaced from the cathode compartment end walls 3*c* and 3*f* by back screen supports 6*h*. The diaphragms are omitted for chlorate, perchlorate or other electrolysis process in which diaphragms are not necessary, and for this use flat solid anode plates are preferably used.

In chlorine producton, for example, the diaphragms separate the anolyte compartments from the catholyte compartments and keep the gases formed in each of these compartments separate, as is well understood in the diaphragm cell art. In the case of chlorine and caustic production from a sodium chlorine brine, the diaphragms keep the chlorine released at the anode from mixing with the sodium hydroxide and hydrogen formed at the cathode. This type of cell, when used for chlorine-caustic soda production, usually operates at a current density of about 2045 amps/m$^2$ and a cell voltage in the individual cell units of about 3.40 to 3.60 volts. The anolyte compartments are operated as completely flooded with anolyte, except for any anolyte gas bubbles which may be moving under the cell cover.

The anodes waves or fingers 5 and the individual cathode fingers 6 are separately formed, assembled and welded to a series of spaced anode support bars 8*b* and to the cathode back screens 6*b*, respectively. The anode support bars 8*b* are connected by means of a series of spaced titanium assembly lugs 8 to titanium studs 7*b* connected to the titanium lining 5*a* of the anode compartments preferably by welding. This permits separate manufacture and assembly of the individual anodes and cathodes and coalignment of the composite connector rods formed by 7, 7*a*, 7*b*, 6*f*, etc., extending between the anodes and cathodes, which produces better conduction and reduces resistance losses in the cells.

The anode end plate 3*a* is provided with a series of rows of circular openings 3*d*. Pre-assembled composite connector rods formed by a steel plug 7, a copper insert 7*a* and a titanium stud 7*b*, preferably welded together by friction welding, are welded into holes 3*d* as shown in FIG. 4. The titanium lining 5*a* of the anode compartment is welded to the titanium studs 7*b*, as shown in FIG. 4, and titanium anode supports 8, are welded to the titanium studs 7*b*. Anode supports bars 8*b*, extending substantially for the entire height of the anode fingers are secured through the assembly lugs 8 to the titanium studs 7*b* and form a wall, dividing the interior of the anode compartments into a front portion housing the anode fingers 5, and a rear portion 5*k*, behind the anode of fingers into which the anolyte which has been brought to the top of the anode fingers 5 by the gas lift effect of the anodic gases in the front portion of the anode compartment can be recirculated downward in the spaces 5*k* to the bottom of the anode compartment. A small gap 8*a*, is left between the anode supports 8 and the anode support bars 8*b* which together with the openings between the spaced assembly lugs 8 allow restricted flow of anolyte between the front and the back of the anode compartments. The gaps 8*a* and the spaces between the anode assembly lugs 8 are relatively small as compared to the solid areas of the anode support bars and the assembly lugs 8. The ratio of solid walls 8*b* to the openings 8*a* is about 6 to 1. This ratio is, however, not critical and the ratio between the solid area and the open area of the separating walls may be slightly larger or smaller.

The reticulated titanium fingers 5 are welded at each side of the base of the fingers 5 to the anode support bars 8*b*. Only two anode fingers 5, one anode finger end wall 5*b* and two anode support lugs 8 are shown in FIG. 4, but it will be understood that the series of anode fingers 5 extends from side to side of each cell unit with an end finger 5*b* at each end of the series of anode fingers 5, as illustrated in FIGS. 4 and 13, and that corresponding cathode fingers 6 extend between each anode finger 5, as illustrated on a larger scale in FIGS. 4 and 5.

The anode support bars 8b provide a wall behind the hollow interior of the anode fingers 5, whereby a portion of the electrolyte which is carried upward in the interelectrodic gap 5c and in the interior of the hollow anode fingers 5 by the rising anodic gas bubbles (chlorine) is recirculated downward in the spaces 5k behind the wall of bars 8b to the bottom of the anode compartments, thus providing up and down circulation from the front to the back of each anode compartment. The open spaces in the wall permit some equalizing flow of electrolyte between the back space 5k and the front portion of the anode compartment but do not interfere with the up and down recirculation of the anolyte. The higher current density at which these cells operate produces a large volume of bubbles in the front portion of the anode compartment, which causes a vigorous upward flow of the electrolyte contained in this portion of the anode compartment and induces a downward movement of the electrolyte within the back space 5k.

In each cell unit, the base of each screen cathode finger 6 is welded to a cathode backing screen 6b through a flared portion 6d, which is also welded to a plurality of short steel bars 6e (see FIGS. 9 to 11). Round steel bars 6f are welded, preferably friction-welded, to the short steel bars 6e, a copper plug insert 7a is preferably friction-welded at the end of each steel bar 6f and for the intermediate cell units a titanium stud 7b is welded, preferably friction-welded, to the copper plug insert 7a. The round steel bars 6f are welded into holes provided in the intermediate separating partitions 3f of the intermediate cell units (FIGS. 4 and 5) and the titanium lining 5a on the anodic side of the intermediate separating partition 3f is welded to the titanium studs 7b.

The cathode fingers 6 are then welded to the short steel bars 6e and to the backing screen 6b and the anode fingers 5 are welded or otherwise connected to the titanium studs 7b by means of the assembly lugs 8 extending from the anode support bars 8b.

The titanium linings 5a and the titanium studs 7b provide a complete separation of the anode compartments from anodic steel end wall 3a and from the steel walls 3f of each of the intermediate separating partitions between the intermediate cell units. The lining 5a and the studs 7b provide a continuous, imperforate titanium wall between the anode compartments and the cathode compartments and prevent the anolyte and anodic gases from contacting the steel end walls 3a and the intermediate steel walls 3f. The intermediate walls 3f welded to the round steel bars 6f provide a continuous imperforate steel wall between the cathode compartments and the back of the titanium linings 5a and prevent any catholyte or catholyte products from contacting the titanium linings of the anode compartments. In the embodiments of FIGS. 1 to 11, the titanium linings 5a are not welded to the steel back plates 3a or 3f and the current essentially flows, between the cell units, along the friction welded composite connectors 6e, 6f, 7a and 7b.

At the terminal cathode end unit illustrated in FIG. 5, the steel bars 6f extend into holes 3e through the cathode end plate 3c and are welded therein. Cathode back screen support bars 6h extend between the intermediate steel separating plates 3f, the terminal cathode end plate 3c and the cathode back screens 6b in each cathode compartment, to support the cathode back screens and provide a space back of screens 6b for free discharge of catholyte liquor and hydrogen to the rear of the cathodes. The copper plugs 7a prevent hydrogen migration through the steel cathode structures into the titanium structures of the cell, which would form titanium hydride and eventually destroy the cell.

As described previously, the interior of each anode compartment is provided with a lining 5a of titanium or other lining material resistant to anodic conditions. Side walls 5b at each end of the anodes waves 5, the interior of frames 2, and the anodes and all connections within the anode compartment are made of titanium or other valve metal, which extends over at least a portion of the flanges 2a.

The interior of the cathode compartments, the cathodes per se, the screen backing for the cathodes, etc., are preferably steel or other ferrous metal which is resistant to cathodic conditions.

For chlorine production the diaphragms on the cathodes and cathode back screens separate each cell unit into an anodic compartment and a cathodic compartment and permit flow of electrolyte through the diaphragms, whereby hydrogen is released at the cathodes to produce hydrogen gas and the sodium ions which combine with the $OH^-$ ions to form sodium hydroxide, and chlorine is released at the anodes.

The intermediate steel separating partitions 3f and the titanium linings 5a provide imperforate partitions between each of the intermediate cell units 1b, 1c, etc. The anode end element 1k is likewise lined with titanium 5a, while the cathode end plate 3c and the cathodic interior of the cathode end unit are steel or other ferrous metal. When chlorates, perchlorates, etc., are produced, the diaphragms are omitted, but the operation of the cell is otherwise the same.

Figure 1:
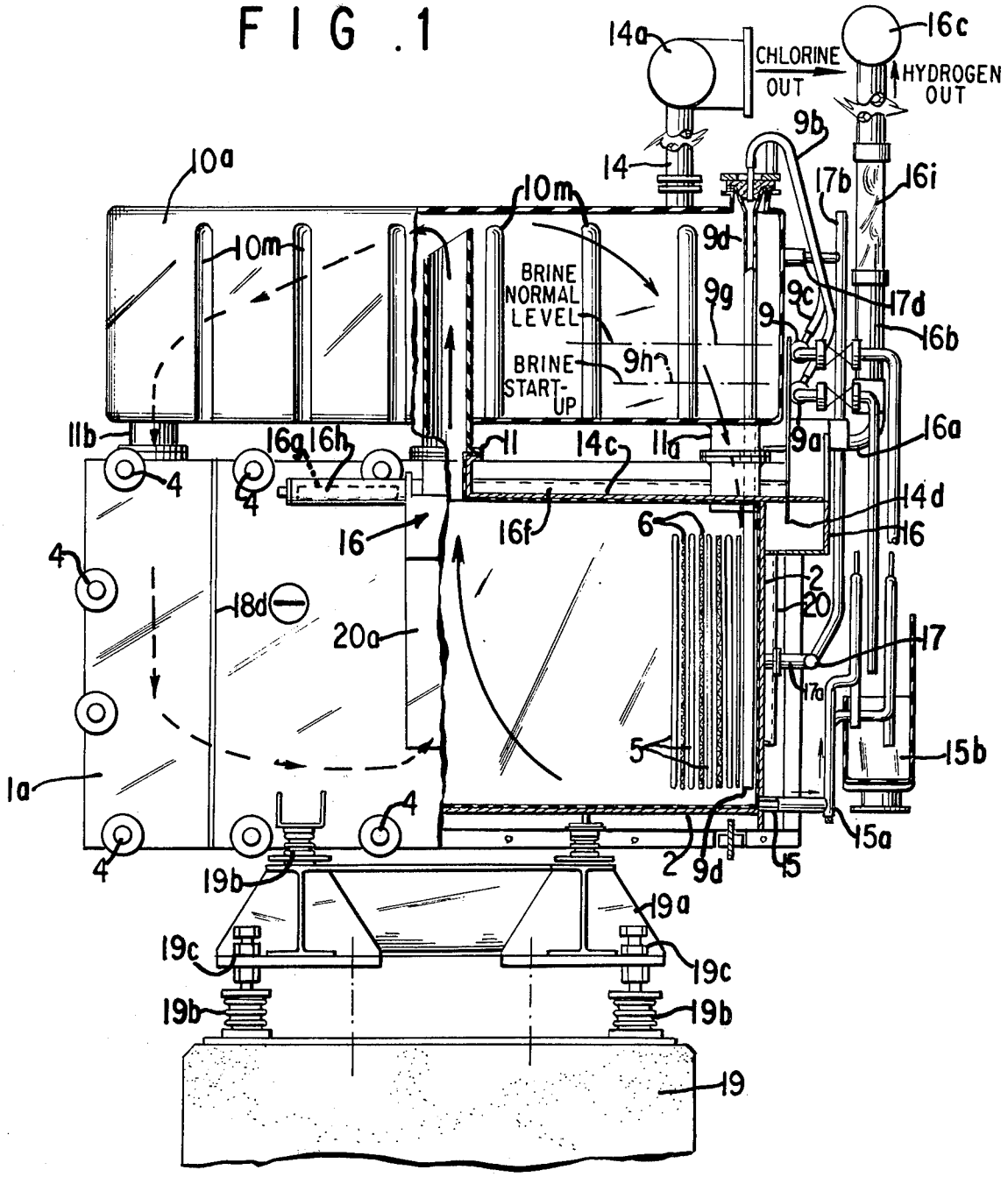
FIG. 1 is a front view, partially in sections, substantially along the line 1 — 1 of FIG. 3, of a bipolar cell.

Brine is introduced into each cell unit 1a, 1b, 1c, 1j, 1k, through brine headers 9 or 9a connected to a brine supply source 9f (FIG. 2). Header 9a is used to fill and start operation of the cell with unsaturated brine, for purging the cells during shutdowns and as an auxiliary supply line in case of any failure or stoppage of the supply of saturated brine through the header line 9. Header 9 is used for normal operation with saturated brine. The use of unsaturated brine during the start-up prevents crystallization of salt in the cells, feed lines, etc. until the cells have reached their normal operating temperature. The brine level in the brine boxes during normal operation is shown by the line 9g (FIG. 1), and the brine start-up level by the line 9h. From the headers 9a or 9, the brine flows through brine feed hoses 9b or 9c into brine feed funnels 9d in each of the fiber glass-reinforced polyester brine boxes 10a, 10b, 10c, 10h, 10g and 10k located above top of each of the cell units 1a, 1b, 1c, 1i, 1j, and 1k. The brine feed hoses are provided with shut-off clamps, etc. The brine feed funnels or dip tubes 9d extend through the brine box approximately to the bottom of each of the cell units 1a, 1b, etc., as shown in FIG. 1, so that the fresh brine is delivered to or below the bottom of the anode fingers 5. The anode fingers 5 and cathode fingers 6 extend approximately from the top to the bottom of the anode and cathode compartments, but are spaced a short distance from the bottom and top of these compartments, as shown in FIGS. 1 and 2, to permit circulation and recirculation of the electrolyte within the cell units and permit escape of anodic and cathodic gases.

Each of the brine boxes 10a, 10b, 10c, etc., is connected with its corresponding cell unit 1a, 1b, 1c, etc., by brine box connections 11a and 11b at each end and a gas riser 11 at the center. The bottom of the gas riser 11 is flush with the top of each anode compartment and the top extends close to the normal operating brine level or just above it so that most of the chlorine (or other anodic gas) flows into the brine boxes through the center connection. The connections 11*a* and 11*b* extend a short distance below the top of the anode compartments and into the brine in the flooded anolyte compartment. Fresh brine flows downward through feed funnel 9*d* and connections 11*a*, and recirculated brine flows downward through connections 11*a* and 11*b* into the anode compartments, so that, in operation, there is a constant recirculation of brine or anolyte downward at each end of the cell units 1*a*, 1*b*, 1*c*, etc., and upward, together with chlorine, through gas riser 11 in the center of each brine box 10*a*, 10*b*, etc., as indicated by the arrows in FIG. 1. Recirculation of the anolyte from the front to the back of each anode compartment of cell unit 1*a*, 1*b*, 1*c*, etc. is provided at the same time by the chlorine gas bubbles rising in the interelectrodic gaps 5*c* between the anodes 5 and the diaphragm covered cathodes 6 and in the spaces 5*d* inside the hollow anode fingers 5, which carry the anolyte upward to the top of the anode compartments where a portion of the anolyte separates from the gas bubbles and flows downward in the spaces 5*k* behind the anode support bars 8*b*, as shown in the arrows in the sectioned cell 1*i* in FIG. 2.

Most of the chlorine gas bubbles, upon reaching the top of the anode compartment, escape through the gas riser 11 imparting an upward thrust to the electrolyte present inside the gas riser 11. The electrolyte rises with the gas to the top of the riser 11 and overflows into the electrolyte pool in the brine boxes 10*a*, 10*b*, etc., whereby the chlorine gas separates from the brine. Simultaneously an equivalent volume of electrolyte moves down through the connections 11*a* and 11*b* and enters the anode compartment near the side walls of the compartment.

The dotted circle 11*a* in FIG. 5 shows the approximate location of the downcoming connection 11*a* with reference to the anode compartment width.

In this way, a circulation motion of the electrolyte to and from the anode compartment and the cooperating brine box is created. This motion, in cooperation with the recirculation motion of the anolyte within each anode compartment resulting from the division of the anode compartment by the separating wall formed by anode support bars 8*b* into a front portion, affected by the upward flow of the gas and of the anolyte, and rear portion 5*k* (FIG. 4) wherein anolyte brought to the top of the anode compartment is recirculated to the bottom of the compartment, produces an intense recirculation of the anolyte from near the side walls towards the center of the anode compartment and through the brine box riser 11 and downcomers 11*a* and 11*b* and from the front to the back or from the top to the bottom of the anode compartment.

The advantages of such a recirculation are many; the composition and temperature of the anolyte are maintained substantially uniform through the cell, the two recirculation motions facilitate rapid evacuation of the gas bubbles from the interelectrodic gap and their disengagement from the electrolyte and allow the full exploitation of the upward thrust imparted by the rising gas bubbles to the electrolyte; the fresh brine, fed into the cell through the feed funnels 9*d*, to make up for the electrolyte which percolates through the diaphragm into the cathode compartments during the operation of the cell, is immediately drawn into circulation. In this way, the cell can tolerate high current densities with very high current efficiencies.

As an alternative to the embodiment illustrated, the brine boxes 10*a*, 10*b*, 10*c*, etc. may be substituted by a single brine box for a multiplicity of cell units 1*g*–1*k*. In this case the gas risers 11 from each cell unit may be connected to a common collector which extends into the brine box to a height close to or just above the normal brine level while the downcomers 11*a* and 11*b* for each cell unit, for the return of the electrolyte, may start from a common distributor pipe connected to the bottom of the brine box.

The connections 11*a* and 11*b* may alternatively be extended to the bottom of the anode compartment or in its proximity, while the gas risers 11 should be as vertical as possible and free of sharp bends or of horizontal sections. The top of the anode compartments may also slope slightly upwards to the gas riser to favor the escape of the gas bubbles reaching the top of the compartment.

Another advantage of the cell of the invention is that the intense recirculation motion of the anolyte allows diaphragm material such as asbestos fibers or powders to be kept in suspension. The diaphragms deposited over the cathode screens are subject to wear and deterioration. In diaphragm cells of the prior art it is necessary to completely renew the asbestos diaphragm every three to seven months of operation. In the cell of the present invention it is possible to introduce a certain amount of asbestos either in fiber or in powder form in the anolyte periodically or when needed. The asbestos fibers, so introduced, are maintained in suspension in the anolyte and are slowly deposited onto the diaphragms, especially at places where the porosity is greater. In this way, limited worn areas of the diaphragm, small holes, etc. become covered with an additional layer of asbestos which prevents the erosion of the diaphragms from proceeding unhindered to an irreversible rupture of the diaphragm and maintains optimum diaphragm porosity during normal cell operation.

Stoppered diaphragm feed inlets 13 are provided at the brine feed end of each brine box 10*a*, 10*b*, 10*c*, etc., through which new diaphragm material may be introduced into the cell units as the diaphragms are eroded or deteriorate in service. The diaphragm material is introduced as a slurry or as moist solid sticks through inlets 13, and is carried downward by the recirculating brine through connection 11*a* to below the bottom of the diaphragm covered cathodes and recirculated upwardly along the cathode fingers 6 and cathode screens 6*b*, where it deposits on any portion of the diaphragm where more diaphragm material is needed to repair the more porous areas which have developed in the diaphgrams.

From the brine boxes 10*a*, 10*b*, 10*c*, etc., the chlorine, separated from the brine, flows through chlorine outlets 14 from each brine box into a chlorine header 14*a* leading to a chlorine manifold outlet 14*b* which is connected to a chlorine recovery or disposal system.

Figure 3:
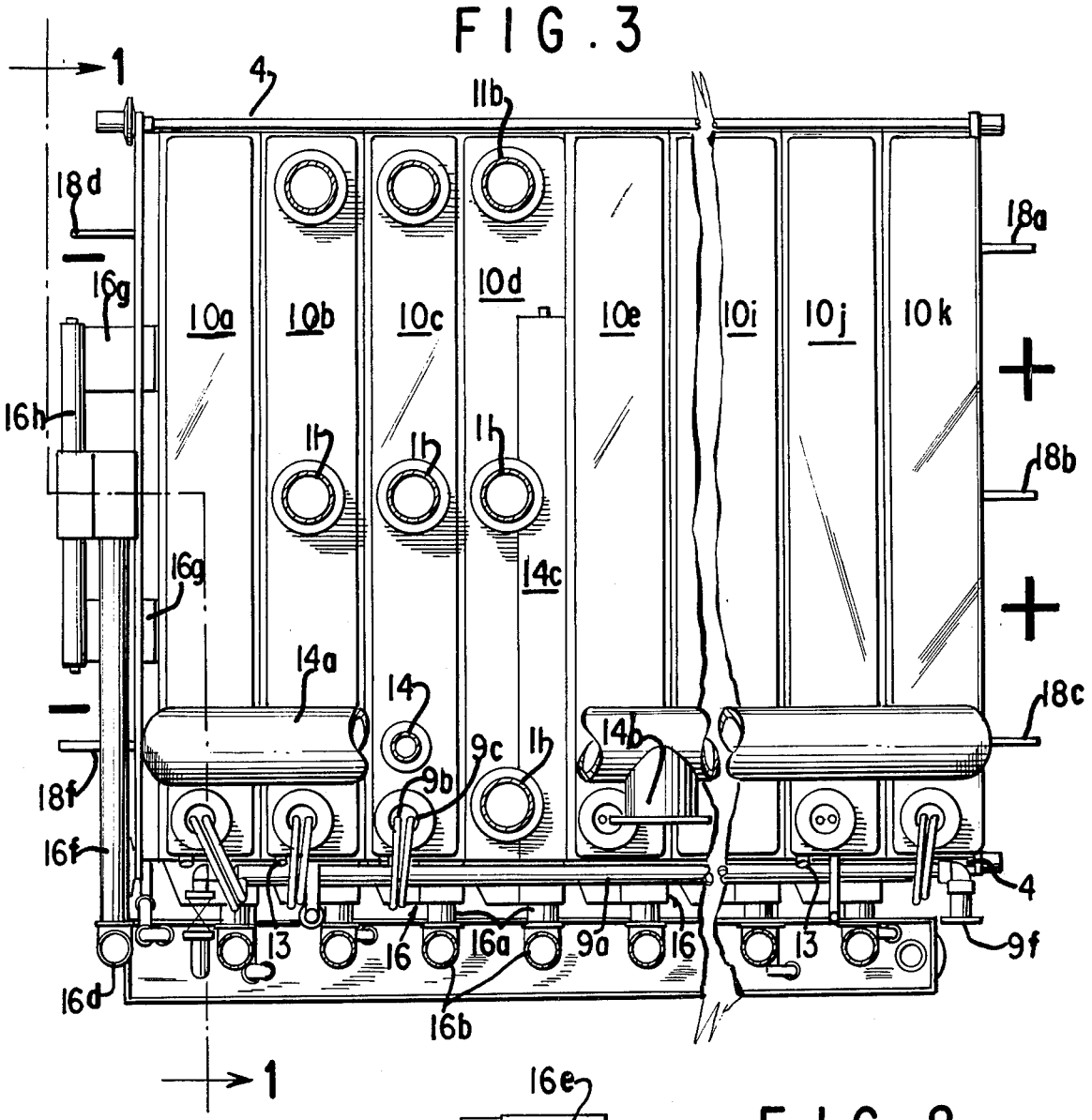
FIG. 3 is a plan view of the bipolar cell illustrated in FIGS. 1 and 2, with portions of the cell omitted.
Figure 4:
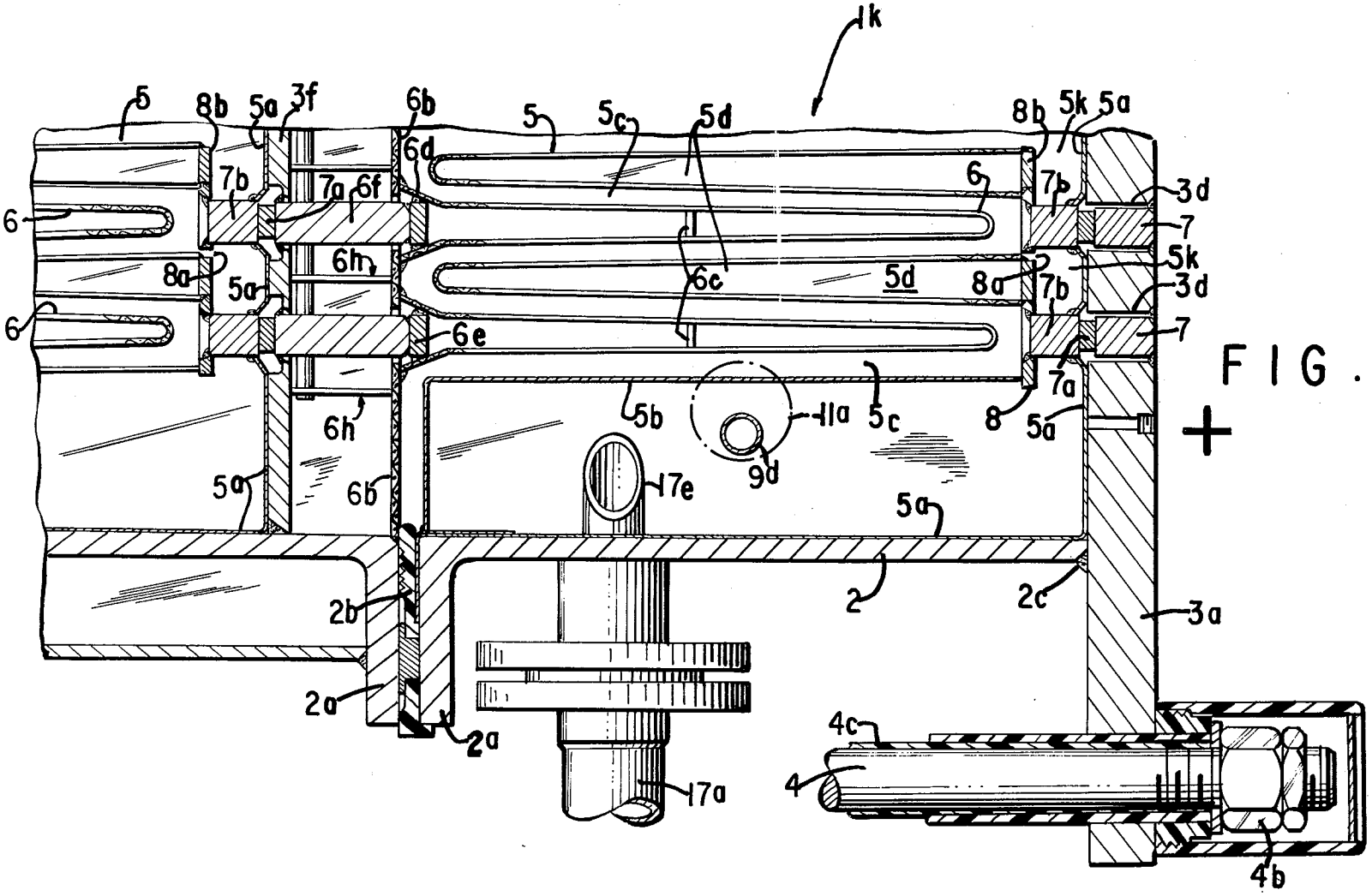
FIG. 4 is an enlarged sectional plan view of a portion of the bipolar cell unit at the anode end of the cell, showing one intermediate separating partition.

As the depleted brine flows through the diaphragms on cathodes 6 and cathode backing screens 6*b*, hydrogen is released at the cathodes and the sodium ions combine with the $OH^-$ ions to produce sodium hydroxide. The sodium hydroxide flows out of each cell unit 1*a*, 1*b*, 1*c*, etc., through a caustic outlet 15 adjacent the bottom of each cathode chamber in the cell units and into pivotted, inverted U-shaped caustic liquor discharge or perc pipes 15*a*, which discharge the caustic into a cell liquor through 15*b*, from which it flows to a caustic recovery or disposal system. The position to which the inverted U-shaped, pivotted pipes 15*a* are turned determines the catholyte level in each of the cell units 1*a*, 1*b*, 1*c*, etc., and controls the flow of anolyte through the diaphragms which depends on the hydrostatic pressure difference across the diaphragms. Hydrogen released in the cathode compartment of each of the bipolar units and separated from the catholyte liquor flows through a hydrogen channel 14*c* along the top of each cathode compartment to the end of the cell units 1*b*, 1*c*, etc., where it flows under baffles 14*d* and through openings (not shown) into a hydrogen discharge box 16 (FIG. 1) and through an opening in the top of box 16 into a hydrogen outlet pipe 16*a* and pipes 16*b* to a hydrogen manifold 16*c* and then to a recovery system. The hydrogen outlet for the intermediate elements is at the end of each cell unit. Each of the hydrogen outlet pipes 16*b* is provided with a pyrex glass section 16*i* which permits inspection of the hydrogen flow and insulates the hydrogen discharge system from the cell currents. The hydrogen outlet for the terminal cathode end element is on the side of the cathode end element and is indicated at 16*d* (FIG. 3). The hydrogen from the terminal cathode chamber in cell unit 1*a* flows from the center of the cell unit through outlets 16*g* in the cathode end element into hydrogen gatherer 16*h*, which connects with extension pipe 16*f* extending between the center of cathode end plate 3*c* and the hydrogen outlet pipe 16*d* for the terminal cathode unit.

A catholyte liquid return channel 20 (FIGS. 1 and 5*a*) extends from the hydrogen discharge box 16 at the top of each cell unit to the lower part of each catholyte chamber, to return any catholyte liquor in the hydrogen discharge stream to the cathode compartments. In the cathode end element a catholyte liquor return channel 20*a* at the center of this element also returns catholyte liquor to the cathode compartment in the cathode end element.

FIG. 5*a* shows a portion of two intermediate cell units in which unit 1*b* is a substantially complete unit and unit 1*c* is partially broken away to show the interior construction. Unit 1*c* shows only the diaphragm covered cathodes 6 with the back screen 6*b* and supports 6*h* spacing the back screen 6*b* from the steel portion of an intermediate separating and supporting plate 3*f*. Unit 1*c* shows the nested titanium anode fingers 5 and cathode fingers 6. The hydrogen channel 14*c* discharges hydrogen into the hydrogen discharge box 16 from which it flows into the $H_2$ outlet pipe 16*a*, equipped with a pyrex glass section 16*i*, and the catholyte liquor flows into the catholyte liquid return channel 20.

Each of the anode compartments is connected to an equalizing header pipe 17 extending along the entire cell, by means of outlet pipes 17*a* (FIGS. 1, 4 and 7) from each cell unit. Each outlet pipe 17*a* has an insulating connection pipe 17*e* (FIG. 7) which projects through the element nozzle 17*f* into the anolyte compartment to protect the titanium lining 5*a* of the anolyte compartment from electrolytic corrosion. Near each end of the header pipe 17, brine level indicator pipes 17*b*, provided with transparent upper portions 17*c* of pyrex glass or other suitable material, extend upward and are connected into the brine boxes 10*b* and 10*j* by connectors 17*d*. The brine header 17 connected with each cell unit 1*a*, 1*b*, 1*c*, etc., assures that the proper brine level will be maintained in each cell unit.

Positive terminal connectors 18*a*, 18*b* and 18*c* are provided at the anodic end of the cell for connection with a suitable DC current, and negative terminal connectors 18*d*, 18*e* and 18*f* are provided at the cathodic end of the cell.

FIG. 13 shows a plan view of the anode fingers 5 and the titanium anode end fingers 5*b* as they are provided in each cell unit and FIG. 13*a* is an enlarged area showing the separating wall formed by the anode support bars 8*b* and assembly lugs 8 and the gaps 8*a*.

FIGS. 14 and 14*a* illustrate the expanded sheet metal reticulated type anodes 5 made of titanium, tantalum or other valve metal, provided with an electrically conducting electrocatalytic coating (not shown in the drawings) on at least one face of the anode. The coated face of each anode is preferably opposite a diaphragm covered cathode face 6, with the interelectric gap therebetween. These anodes have diamond-shaped openings 5*e*, in which the bottom central portion 5*g* of each diamond is rearward of the vertical center plane of the anode and the top central portion 5*h* of each diamond is forward of the vertical center plane of the anode face. The corners of each diamond-shaped opening lie approximately in the vertical plane of the anode. The lower half 5*g* of each diamond-shaped opening is tilted or pushed toward the cathode C (FIG. 14*a*), while the upper half 5*h* of each diamond-shaped opening is tilted or pushed away from the cathode C, so that gases released on the lower half of and below each diamond-shaped opening pass through said opening to the back or rear of the anode (away from the cathode) and are deflected rearwardly of the anode by the forwardly tilted upper half of the diamond-shaped opening and into the electrolyte space at the rear or inside the hollow fingers 5 of the anode, as indicated by the arrows 5*i* in FIGS. 14*a* and 15. In FIG. 14, the solid portions of the arrows 5*i* indicate the path of the gases along the lower leg of each diamond-shaped opening and the dotted portion of the arrows indicate the path of the gases behind the upper portion of each diamond-shaped opening and away from the cathode. By this construction most of the gas released along the legs which are tilted to the rear of the anode, when released into the diamond-shaped opening, is deflected to the rear of the anode by the legs which are tilted toward the front of the anode. In this way, most of the gases released along the coated face of the anodes are directed through the opening in the anodes and deflected to the interior 5*d* of the anode fingers 5, away from the interelectrodic gap between the anode faces and the cathodes and their diaphragms. FIG. 15 is an enlarged area of the anode of FIG. 14.

While diamond-shaped openings 5*e* have been illustrated in FIGS. 14, 14*a* and 15, it will be understood that square, round, triangular, hexagonal or other shaped openings may be provided in anode faces, with the lower portion of each opening tilted toward the side of the anode facing the cathode and the upper portion of each opening tilted or pushed toward the side of the anode facing the interior 5*d* of the anode fingers, to accomplish the same object, namely, to pass the gases released at the front of each anode through the opening therein and deflect them to the rear of each anode and into the interior of the hollow anode fingers which provide a larger area for the escape of the anodic gases than the interelectrodic gap per se.

Instead of reticulated metal, the walls of the anodes may be formed of spaced titanium rods 5*j*, vertically mounted on suitable supports 5*k*, attached to anode support bars 8*b*, as illustrated in FIG. 16, in which the anodic gases formed in the interelectrodic gap readily pass between the rods and into the hollow interior of the anode fingers.

FIGS. 17 and 18 illustrate a modified construction, in which the anode fingers 5 are mounted on support bars 8*b* having gaps 8*a* between each support bar, and the anode assembly lugs 8. The anode assembly lugs 8 are connected by welding, or otherwise, to titanium studs 7*b* welded to an imperforate titanium liner 5*a*, which is on the anodic side of the positive end steel support plate 3*a* and of the intermediate steel supporting plates 3*f*. In this embodiment the titanium lining 5*a* is welded to the steel plates 3*a* and 3*f* so that current flows through the end plates 3*a*–5*a* and the intermediate separating partitions 3*f*–5*a* from the anodes to the cathode end of the cell. The screen cathodes 6 in FIGS. 17 and 18 are mounted between the anodes 5, as described in connection with FIGS. 4 and 5, on angular steel supports 6*h*, which project from the cathode end plate 3*c* and the intermediate steel partitions 3*f*, so that the anode end plate 3*a*, the cathode end plate 3*c* and the intermediate partitions 3*f* do not have holes therethrough. For chlorine production the cathodes 6 are provided with diaphragms as described previously. The other portions of FIGS. 17 and 18 are similar to like parts in FIGS. 4 and 5.

In both the main embodiments of FIGS. 1 to 16 and the modified embodiment of FIGS. 17 and 18, the titanium linings 5*a* and titanium studs 7*b* form an imperforate valve metal lining for the anode compartments, and the valve metal support studs 7*b* projecting from the lining 5*a* support the anode fingers mounted on anode support bars 8*b*, so that the bases of the hollow anode fingers are spaced from the lining 5*a* of the anode compartments to provide a downward recirculating space 5*k* for the electrolyte behind the support bars 8*b*.

The cell is mounted on a suitable insulated base 19, supporting channel members 19*a*, insulators 19*b* and adjustable levelling bolts 19*c*. Teflon sliding plates (not shown) on channel members 19*a* permit sliding the element along the support for assembly and disassembly.

The fiberglass-reinforced polyester brine boxes 10*a*, 10*b*, 10*c*, etc. have strengthening indentations $10^m$ (FIG. 1) formed in their side walls, which, however, do not prevent flow of brine from end to end of the brine boxes. The space above the brine normal level indicated in FIG. 1 is occupied by chlorine and whatever foam is formed, and the flow of brine from the center chlorine outlet 11 to the down connections 11*a* or 11*b* tends to break the foam and release chlorine bubbles trapped therein.

The embodiments of the invention shown, are for illustrative purposes only, and various modifications and changes may be made within the spirit and objects of this invention. The cells illustrated may be used as unipolar single cells or as bipolar multiple cells, and while titanium and steel have been described as the preferred metals of construction, any valve metal or film-forming metal may be used for the anodic portions and any ferrous metal may be used in the cathodic portions of the cells and various dissimilar metals may be used for the anodic and cathodic portions of the cell units. Examples of other suitable anode metals are lead, silver and alloys thereof and metals which contain or are coated with $PbO_2$, $MnO_2$, $Fe_3O_4$, etc., and examples of other suitable cathode metals are copper, silver, stainless steel, etc. The metals and plastics used should be suitable to resist the corrosive or other conditions encountered in the anode and cathode compartments and other portions of the cells when operating on a particular electrolyte. While diaphragms on the cathodes will usually be used, diaphragms may be used on both anodes and cathodes. When non-porous ion-selective membranes are used as diaphragms a continuous recycling of at least a portion of the anolyte and of the catholyte must be provided in order to keep the concentrations of both the anolyte and of the catholyte constant. The cells can be used without diaphragms for certain purposes, such as chlorate, perchlorate, hypochlorite, periodate production, and for other electrolysis processes in which diaphragm separation of the electrolysis products is not necessary. In such cases the entire cell compartment and the structures therein must be made of suitable material that is non-corridible by the electrolyte and the products of the electrolysis. The cathode structures are preferably made exactly as the anode structures thus providing two recirculation spaces behind the walls supporting the electrodes so that the gas liberated on the electrodes flows upwards in the central portion of the cell compartment and part of the electrolyte brought to the top of the compartment is recirculated to the bottom of the compartment through the spaces behind the two walls formed respectively by the assembly of the anode support bars and by the assembly of the cathode support bars.

What is claimed is:

1. Electrolysis cell units for the electrolysis of alkali halide brines, having an anode compartment and a cathode compartment therein, a metal separating partition between each said cell unit and the next adjacent cell unit, comprising a ferrous metal in the cathode compartment and a valve metal in the anode compartment, a metal frame around said anode and cathode compartments, a continuous, imperforate valve metal lining in the anode compartment of said frame and on said separating partition, resistant to the corrosive conditions in said anode compartment, an electrolyte in said cell units, valve metal support studs projecting from said continuous, imperforate valve metal lining, anode support bars connected to said support studs, said anode support bars forming a substantially imperforate separating wall within said anode compartments, separating the anodes from said valve metal separating partition and providing a space at the rear of the anodes for downward recirculation of said electrolyte, a plurality of hollow finger-like valve metal anodes supported on said support bars, a plurality of hollow finger-like cathode waves between said valve metal anode waves, means to pass an electrolysis current through said cell unit and the electrolyte contained therein to circulate said electrolyte upward along both the front and in the interior of said anode waves by the gas lift effect of the gases formed in the electrolysis, and downward behind said anodes, means to collect anodic gases produced in said cell unit and means to collect cathodic gases and cathode liquor produced in said cell unit.

2. The cell units of claim 1 in which the units are connected together with the ferrous metal separating partitions in the cathode compartments connected to the continuous valve metal partitions in the anode compartments to form a bipolar connection between one cell unit and the next adjacent cell unit.

3. The cell unit of claim 1, in which said valve metal support studs are connected through a copper insert to steel conductor rods extending into the cathode compartment of an adjacent cell unit.

4. The cell of claim 2, in which said valve metal support studs are connected to steel conductor rods extending through the said ferrous metal separating partitions and are connected to the base of a hollow finger-like cathode finger of an adjacent cell unit.

5. The cell of claim 2, in which a diaphragm separates the anode and cathode compartments of each cell unit.

6. The cell of claim 1, in which said separating wall has openings to allow restricted flow of electrolyte between the front and back of the anode compartments.

7. In an electrolysis cell, a plurality of cell units, a rectangular frame around each cell unit, an anode compartment and a cathode compartment in each cell unit, said anode compartments and cathode compartments being separated from the anode and cathode compartments of the adjacent cell units by a separating partition of a ferrous metal on the cathode side and an imperforate valve metal separating partition on the anode side, said frames being substantially rectangular and the anodes and cathodes extending substantially from top to bottom and from side to side of said frame, a plurality of separate valve metal anodes in hollow finger form in each said anode compartment, valve metal anode support bars at the base of the fingers of said anodes, anode electrical connectors spacing said support bars from said valve metal separating partition, an electrically conductive electrocatalytic coating on said anode fingers, a plurality of metal cathodes in hollow finger form in said cathode compartments, cathode electrical connectors, extending through the ferrous metal partition, between the base of said cathode fingers and the anode electrical connectors, said electrical connectors spacing the cathodes from the ferrous metal of said partitions, said anodes and cathodes extending substantially vertically in said compartments, substantially from the top to bottom and from side to side of said compartments, said anodes and cathodes being offset with reference to each other and being nested together to provide a substantially uniform spacing between the anode and cathode surfaces, each anode being a complete and separate shaped finger attached to its base and each cathode being a complete and separate shaped finger attached to its base, the sides of said fingers being parallel whereby each side of an anode finger faces the side of a different cathode finger, a lining on the side walls of said anode compartments resistant to the electrolyte and electrolysis conditions, means to feed an electrolyte to said cell, means to pass an electrolysis current through the electrolyte between said anode and cathode surfaces, means to discharge anodic gases and cathodic gases from said cell, and means to discharge a catholyte liquor from the cathode compartments of said cell.

8. The cell of claim 7, in which diaphgrams are provided between the anode and cathode waves.

9. A bipolar electrolysis cell according to claim 8, in which the cathodes are diaphragm-covered steel net on a cathode backing screen spaced from said separating partition, and the anodes are open mesh titanium provided with a conductive electrocatalytic coating.

10. A bipolar electrolysis cell according to claim 9, in which the anodes are in the form of closed-end hollow fingers extending from the valve metal anode support bars, the cathodes are in the form of hollow fingers projecting between the anode fingers, the rectangular frame is titanium lined, the anode fingers and the cathode fingers nest together providing a uniform spacing therebetween and the imperforate valve metal separating partitions and the ferrous metal separating partitions are held together, back to back, and bipolar metallic electrical connectors extend through said ferrous metal partitions between the base of said anode fingers and cathode fingers.

11. A bipolar cell according to claim 10, in which the current flows between the anodes fingers and the cathode fingers essentially through the electrolyte and along said bipolar electrical connectors.

12. A bipolar electrolyzer according to claim 10, in which the cathode compartments are surrounded by a rectangular frame and said frame has holes for the passage of catholyte liquor through a side of said frame to an adjustable catholyte outlet.

13. The cell of claim 7, in which said valve metal anode support bars form a separating wall between the base of the anode fingers and the imperforate valve metal separating partition, and said anode electrical connectors space the separating wall of support bars from the imperforate valve metal separating partition to form a path for the downward recirculation of electrolyte.

14. The anode of claim 13, in which the separating wall between the base of the anodes and the imperforate valve metal separating partition has openings therein to permit restricted flow of electrolyte therethrough.

15. A bipolar electrolyzer according to claim 7, in which a chlorine resistant brine box at the top of each cell unit receives produced anodic gas and electrolyte from the cell unit and recirculates the electrolyte back to the cell unit.

16. A bipolar electrolyzer according to claim 15, in which stoppered openings are provided in said brine boxes to receive diaphragm repair material.

17. The cell of claim 15, in which anodic gas and electrolyte flows from a cell unit into the center of said brine box above the electrolyte level therein and the recirculated electrolyte flows from the brine boxes into the end of the cell unit.

18. The cell of claim 7, in which the anodes are titanium and the lining of the anode compartment is titanium.

19. The cell of claim 7, in which the anodes are of open mesh construction and each cell unit is provided with a diaphragm and means are provided to regulate the level of the catholyte liquor in the cathode compartments.

20. The cell of claim 7, in which the means to discharge catholyte liquor from the cathode compartment constitutes an adjustable tube to control the catholyte liquor level in said cell unit.

21. The cell of claim 7, in which the rectangular frame of each cell unit is provided with flanges matching with the flanges of the adjacent cell unit, insulating gaskets are provided between said flanges and all the cell units are held together, in fluid tight connection with said flanges in contact with said gaskets, by tie rods insulated from their surrounding parts.

22. In a bipolar electrolysis cell, a positive end unit containing anodes and cathodes, a negative end unit containing anodes and cathodes and a plurality of intermediate units containing anodes and cathodes, all of said units being substantially rectangular and each of said units having an anode compartment and a cathode compartment, said anode compartments, and cathode compartments being separated from the adjacent cell units by a separating partition of ferrous metal on the cathode side and imperforate valve metal on the anode side, a corrosion resistant lining on the side walls of each of said anode compartments, said units being connected in series to pass an electrolysis current through all of said cell units, the anodes being constructed of a valve metal in the form of separate, mesh hollow finger-like waves and the cathodes being constructed of ferrous metal in the form of separate hollow finger-like waves, said anode and cathode waves being offset with reference to each other and nested together to provide a substantially uniform spacing between the anode and cathode surfaces, means to permit anodic gases rising through the electrolyte to escape from the electrolyte from both the interelectrodic gap between the anodes and cathodes and the space inside the hollow finger-like waves of the anodes and from the top of each cell unit, anode support bars between the base of the anodes and the imperforate valve metal separating partitions, means to space the base of the anodes from the separating partitions to provide a passage through which electrolyte can be recirculated to the bottom of the anodes, the cathodes of one cell unit being connected with the anodes of the adjacent cell unit by metal electrical connections between the valve metal anodes and the ferrous metal cathodes through said separating partitions.

23. The electrolysis cell of claim 22, in which the anodes are formed of titanium, having an electrocatalytic conductive coating thereon, the cathodes are formed of ferrous metal and a diaphragm is provided between the anodes and cathodes.

24. The cell of claim 23, in which the anodes are supported from the imperforate valve metal portion of said separating partitions by titanium studs to which the bases of the anodes are connected by titanium support bars, a titanium lining is provided on the side walls of the anode compartments, the cathodes are supported on the ferrous metal portion of said separating partitions and the two portions of said separating partitions are held together back to back with a metal-to-metal contact.

25. The cell of claim 24, in which the space between the cathodes and the ferrous metal portion of the separating partitions forms a catholyte chamber, openings are provided in said catholyte chamber to discharge catholyte liquor and catholyte gas therefrom and means are provided to separately collect said catholyte liquor and catholyte gas.

26. The electrolysis cell of claim 22 in which the cathodes of one cell unit are connected to the anodes of the adjacent cell unit by rod like connections through which the current principally flows between the cell units.

27. The electrolysis cell of claim 26 in which the rod like connections consist of steel, copper and titanium sections friction welded together.

28. The electrolysis cell of claim 22 in which the valve metal and ferrous metal of said separating partitions are welded together and the current flows from one cell unit to the adjacent cell units principally through the welded separating partitions.

29. In an electrolysis cell, substantially vertical electrodes, at least one anode compartment and at least one cathode compartment separated from the anode compartment by a diaphragm, means to maintain the anode compartment flooded with electrolyte, foraminous metal anodes in said anode compartment, foraminous metal cathodes in said cathode compartment, a wall in said anode compartment supporting said anodes, spaced from the imperforate back wall of the anode compartment and extending from a short distance from the bottom of the compartment to a short distance from the top of the compartment, said wall defining a front portion of the compartment, housing the foraminous metal anodes, wherein the gas liberated on the anode surface imparts an upward motion to the electrolyte, and a back portion wherein part of the electrolyte brought to the top of the compartment flows down towards the bottom of the compartment, non-corrodible lining on corrodible surfaces in the anode compartment, means to pass an electrolysis current through said cell, means to discharge anodic gas produced in said cell, means to discharge cathodic gas and cathode liquor from the cathode compartment and means to feed fresh electrolyte into the cell.

30. In an electrolysis cell, substantially vertical electrodes, at least one anode compartment and at least one cathode compartment separated from the anode compartment by a diaphragm, means to maintain the anode compartment flooded with electrolyte, foraminous metal anodes in said anode compartment, foraminous metal cathodes in said cathode compartment, a brine box above said cell, means to maintain the level of the electrolyte in said brine box substantially constant, connections between said brine box and said anode compartment through at least two flooded conduits, one of which is flush with the top of the anode compartment and extends substantially vertically inside the brine box to substantially the height of the normal electrolyte level in said brine box, and the other conduit leads from the bottom of said brine box into the top of the anode compartment to a point substantially below the top of the compartment, whereby the anodic gas liberated on the anode surface, upon reaching the top of the anode compartment, escapes through the conduit which is flush with the top of the anode compartment and impresses an upward motion to the electrolyte contained inside said conduit and a downward motion of the electrolyte through said other conduit takes place to cause a center-to-side recirculation of electrolyte within the anode compartment, means to impress an electrolysis current through said cell, means to discharge anodic gas above the electrolyte level in said brine box, means to discharge cathodic gas and cathode liquor from the cathode compartment and means to feed fresh electrolyte into the cell.

* * * * *